United States Patent [19]

Marcotti

[11] Patent Number: 4,955,842

[45] Date of Patent: Sep. 11, 1990

[54] FLYING DISK WITH RETRIEVING DEVICE

[76] Inventor: Ettore Marcotti, 28 Cleveland Pl., Palisades Park, N.J. 07650

[21] Appl. No.: 295,446

[22] Filed: Jan. 10, 1989

[51] Int. Cl.[5] ..... A63H 27/00

[52] U.S. Cl. ..... 446/46; 273/322

[58] Field of Search ..... 446/46, 47, 48; 273/424, 425, 318, 327, 322; 124/5

[56] References Cited

U.S. PATENT DOCUMENTS

| | | | |
|---|---|---|---|
| 2,227,705 | 1/1941 | Colucci | 273/322 |
| 2,953,378 | 9/1960 | La Veigne, Jr. | 273/425 X |
| 3,082,572 | 3/1963 | Knox, Jr. | 446/46 |
| 3,935,663 | 2/1976 | Leibowitz | 446/48 |
| 4,117,626 | 10/1978 | Kifferstein | 446/47 |
| 4,183,168 | 1/1980 | Ross | 446/46 X |
| 4,209,936 | 7/1980 | Sklar | 446/46 |

*Primary Examiner*—Mickey Yu

*Attorney, Agent, or Firm*—Collard, Roe & Galgano

[57] ABSTRACT

There is provided a game toy in the form of a flying disk with a handling device for retrieving the flying disk. The flying disk consists of a standard sized and shaped flying disk having a smaller disk-shaped element axially attached to and spaced from the convex side of the flying disk by means of a spacer. The handling device consists of an elongated sword-like element having a handle portion and a flat blade portion which is adapted to engage the flying disk in the groove defined between the flying disk and the disk-shaped element so that the disk-shaped element rolls or rides on the blade portion of the handling device in the nature of a grooved wheel on a track. The handling device is used in retrieving the flying disk, so that the flat blade portion of the handling device is inserted into the groove between the two disks while the flying disk is in flight and caused the same to stop.

8 Claims, 1 Drawing Sheet

FLYING DISK WITH RETRIEVING DEVICE

The present invention relates generally to game toys and sport apparatus and, more particularly, it relates to a flying disk with a handling device for retrieving the disk.

The flying saucer-like disk has been a very popular game toy since its introduction a number of years ago. Such a flying disk game toy was first patented under U.S. Pat. No. 3,359,678, to Headrick, granted Dec. 26, 1967, and the present day flying disk toy is essentially unchanged therefrom. As disclosed in the Headrick patent, the flying saucer-like disk has a substantially convexly shaped outer rim which merges centrally with a planar circular portion and, on the other side thereof, the outer rim surface of the game toy is substantially concave and merges with the planar circular inner surface. The outer convex curved surface also includes air spoiling means in the form of a plurality of concentric circular raised ribs which aid in giving the flying disk lift when the same is thrown in a specified manner by the user.

The unique aerodynamic characteristics of the flying disk allows skillful throwers to perform many different maneuvers with the toy. Such skillful throwers can utilize the aerodynamic properties of the flying disk to create unusual flight patterns, such that varying the velocity of the disk or its angle of release with respect to the ground or the body, may cause the disk to float in a gentle arc, to act as a boomerang, to ricochet off the ground or to travel through the air in other predictably unique flight patterns.

The catcher of such a flying disk is somewhat limited with respect to retrieving the disk since usually it is the intent to catch the disk by hand before the disk hits the ground. The catcher, after having caught the flying disk, then becomes a thrower by propelling the disk back to the original thrower or another player. In U.S. Pat. No. 4,040,625, to Malafronte, granted Aug. 9, 1977, there is disclosed an attachment or extension to the finger of the catcher of a flying disk which aids the catcher in retrieving the flying disk by permitting the catcher to utilize the extension to engage the concave portion of the disk, thereby allowing the disk to twirl around the extension. This extension increases the maneuvers available to the catcher. Generally, the catcher of the flying disk faces the not insignificant risk of injury when catching the disk, since the disk is usually travelling at relatively high speed and, because of its mass, the momentum of the disk is high enough to cause injury if the catcher should fail to catch the disk and it strikes him or her. Such an injury may be severe because of the momentum of the flying disk itself, in combination with the point-like impact area which the disk presents.

It is, therefore, the object of the present invention to provide a flying disk-type game toy which can be caught with safety by the game players and which enhances the pleasure of play by introducing further and additional maneuvers into the games played with the flying disk.

The above object is accomplished in accordance with the present invention by providing a standard sized and shaped circular flying disk with a smaller disk-shaped element axially attached to and spaced from the convex side of the flying disk by means of a spacer. The outer surface of the disk-shaped element is convexly shaped and disposed to face the convex side of the flying disk.

A handling device for retrieving the flying disk is associated therewith and consists of an sword-like element having a handle portion and an elongated flat blade portion which is adapted to engage the flying disk in the groove defined between the flying disk and the disk-shaped element, so that the spacer between the two rides or rolls on the blade portion of the handling device in the nature of a grooved wheel on a track. In this way, the flying disk rolls on the blade of the handling element so that it can be retrieved by engaging the blade of the handling device in the groove of the flying disk while it is in flight to permit the same to stop or slow down on the track-like blade of the handling device.

Other objects and features of the present invention will become apparent from the following detailed description considered in connection with the accompanying drawing. It is to be understood, however, that the drawing is designed as an illustration only and not as a definition of the limits of the invention.

In the drawing, wherein several reference characters denote similar elements throughout the several views.

Figure 1:
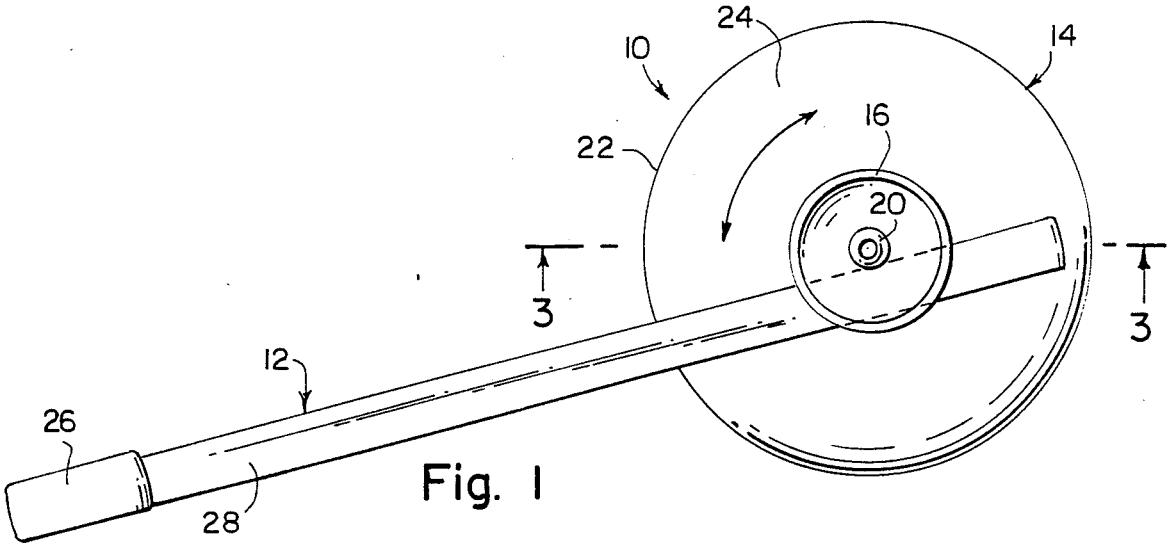
FIG. 1 is a plan view of the flying disk with a handling device according to the present invention.

Now turning to the drawing, there is shown in FIG. 1 a flying disk, generally designated 10, and a handling device, generally designated 12, for retrieving the flying disk. Flying disk 10 consists of a circular flying disk element 14 of standard size and shape, as clearly seen in FIGS. 3 and 4, having axially attached thereto a smaller disk-shaped element 16, which is spatially separated from flying disk element 14 by bushing 18. Bushing 18 is coaxial with both flying disk element 14 and disk-shaped element 16, and all are axially fastened together by rivet means 20.

Flying disk element 14 has a generally convexly shaped outer rim portion 22 which merges with central planar portion 24 and may be provided with air spoiling means (not shown) on the outer surface thereof for the purpose of increasing the aerodynamics of the flying disk. Disk-shaped element 16 is saucershaped, having its substantially convex outer side facing the outer convex side of flying disk element 14, as clearly seen in FIG. 3. Thus, bushing 18 maintains a fixed spatial separation between flying disk element 14 and disk-shaped element 16.

Figure 2:
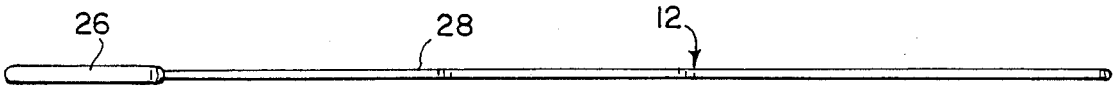
FIG. 2 is a side elevational view of the handling device according to the present invention as shown in FIG. 1.

As clearly seen in FIGS. 1 and 2, handling device 12 is sword-like having a handle portion 26 and an elongated flat blade portion 28. Blade portion 28 of handling device 12 has a relatively thin cross-sectional dimension, as seen in FIG. 2, which is less than the axial dimension of bushing 18 which spatially separates flying disk element 14 from disk-shaped element 16.

Thus, blade portion 28 is adapted to engage in groove 30 defined between flying disk element 14 and disk-shaped element 16, as clearly seen in FIG. 1, thereby permitting flying disk 10 to roll or ride on blade portion 28 as a grooved wheel would roll or ride on a track. In order to retrieve flying disk 10 in flight, the catching player, who is provided with a handling device 12, "catches" the flying disk by engaging blade portion 28 of handling device 12 in groove 30 of flying disk 10 while in flight to thereby permit the same to slow down and stop.

Preferably, flying disk element 14 and disk-shaped element 16 are formed of plastic material while handling device 12 may be formed of plastic, metal or wood. Flying disk element 14 is preferably a standard flying disk having the size, shape and construction of a flying disk with the aerodynamic properties common thereto.

Figure 5:
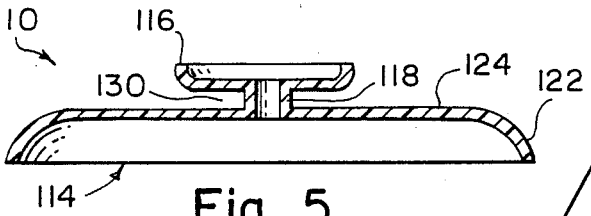
FIGS. 5 and 6 show other types of constructions of the flying disk of FIG. 1.
Figure 4:
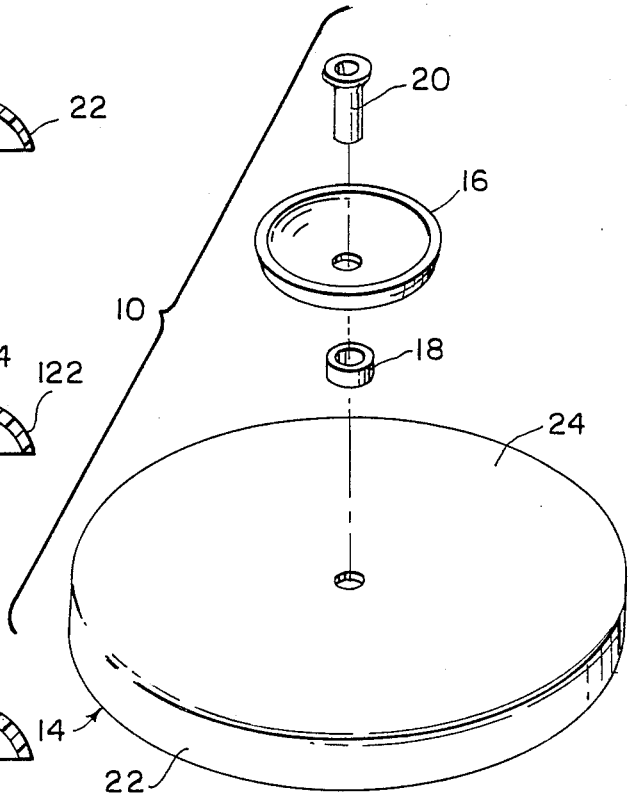
FIG. 4 is an exploded view of the flying disk according to the present invention.

Referring to FIG. 5, there is shown another embodiment of the disk 110 having a disk-shaped element 116 integrally formed with a spacer 118 used in place of bushing 18 and connected with flying disk element 114. The shape of flying disk element 114 with its outer rim portion 122 and its flat connecting portion 124 is similar to the shape of rim portion 22 and flat portion 24 of the embodiment shown in FIGS. 1 and 2. Flying disk 110 of FIG. 5 is preferably constructed of a single piece of molded flexible material, such as plastic, so that there is no need to assemble it from a plurality of pieces, as shown in FIG. 4.

Figure 3:
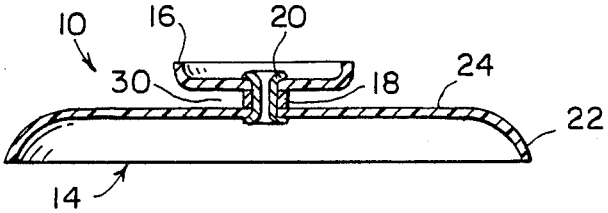
FIG. 3 is a cross-sectional view of the flying disk of FIG. 1 taken along the line 3—3 of FIG. 1.
Figure 6:
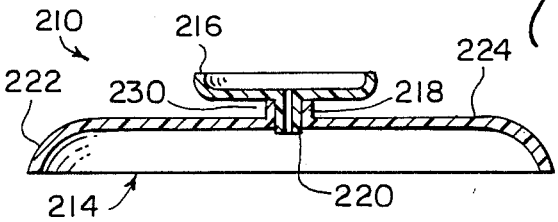

Referring to FIG. 6, there is shown another embodiment of the disk designated as 210 having a disk-shaped element 216 similar to element 16 of FIG. 3. Likewise, flying disk element 214 has a similar outer rim portion 222 and flat portion 224, as rim and flat portions 22 and 24, respectively. In the embodiment of FIG. 6, the stem 220 of disk-shaped element 216 is inserted through an opening in the center of flying disk element 214 and is held in place by either friction or plastic cement.

While three embodiments of the present invention have been shown and described, it will be obvious that many changes and modifications may be made thereunto without departing from the spirit and scope of the present invention.

What is claimed is:

1. A flying disk with handling device, comprising:

(a) a circular flying disk having a saucerlike generally convexly-shaped outer surface;

(b) a saucer-like disk-shaped element having a generally convexly shaped outer surface, substantially smaller in diameter than said flying disk, co-axially fastened to said flying disk so that the generally convexly shaped outer surfaces thereof face each other and are spaced from each other to define a groove therebetween, the respective perimeters of said flying disk and said disk-shaped element being thus arranged to define between them an aperture substantially greater than the dimension of said groove; and (c) a sword-like handling device for retrieving said flying disk having a handle portion and an elongated flat blade portion, the blade portion of said handling device having a cross-sectional dimension smaller than the groove defined between said disk-shaped element and said flying disk, wherein said disk-shaped element and said flying disk are spaced apart from one another by an axially arranged bushing whose axial length is greater than the cross-sectional dimension of the flat blade portion of said handling device; and whereby the size of the aperture defined between the perimeters of the flying disk and the disk-shaped element and the central planar portion of the flying disk facilitates the entry of said flat blade portion into the groove between the walls of the flying disk and the disk-shaped element so as to ease the retrieval of said flying disk, the flying disk riding or rolling on the flat blade portion as a wheel would ride or roll on a track.

2. The flying disk with handling device as defined in claim 1, wherein said flying disk, said disk-shaped element and said bushing are coaxially fastened together by means of a through going rivet means.

3. The flying disk with handling device as defined in claim 1, wherein said flying disk and said disk-shaped element are formed of plastic.

4. The flying disk with handling device as defined in claim 1, wherein said handling device is formed of plastic.

5. The flying disk with handling device as defined in claim 1, wherein said handling device is formed of wood.

6. The flying disk with handling device as defined in claim 1, wherein said handling device is formed of metal.

7. The flying disk with handling device as defined in claim 1, wherein said flying disk and said disk-shaped element and said bushing are integrally formed as a one-piece plastic construction.

8. The flying disk with handling device as defined in claim 1, wherein said disk-shaped element is integrally formed with a bushing and secured coaxially through a central opening with said flying disk.

* * * * *